US008870343B2

(12) United States Patent
Komatsu et al.

(10) Patent No.: US 8,870,343 B2
(45) Date of Patent: Oct. 28, 2014

(54) INK JET RECORDING APPARATUS AND METHOD OF WIPING RECORDING HEAD DISCHARGE PORT ROW GROUPS

(71) Applicant: Canon Kabushiki Kaisha, Tokyo (JP)

(72) Inventors: Hiroaki Komatsu, Yokohama (JP); Masaya Uetsuki, Yokohama (JP); Kazuo Suzuki, Yokohama (JP); Toshimitsu Danzuka, Tokyo (JP); Masataka Kato, Yokohama (JP); Tsuyoshi Ibe, Yokohama (JP); Asako Tomida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/830,321

(22) Filed: Mar. 14, 2013

(65) Prior Publication Data

US 2013/0257931 A1 Oct. 3, 2013

(30) Foreign Application Priority Data

Mar. 30, 2012 (JP) ..... 2012-079534
Jan. 29, 2013 (JP) ..... 2013-014452

(51) Int. Cl.
*B41J 2/165* (2006.01)

(52) U.S. Cl.
CPC ..... *B41J 2/16535* (2013.01); *B41J 2/16552* (2013.01); *B41J 2002/1655* (2013.01)
USPC ..... 347/33; 347/22; 347/32

(58) Field of Classification Search
CPC ..... B41J 2/16505; B41J 2/16535; B41J 2/16552; B41J 2/1707; B41J 2/1714; B41J 2/16538
See application file for complete search history.

(56) References Cited

U.S. PATENT DOCUMENTS 5,969,731 A * 10/1999 Michael et al. ..... 347/33

FOREIGN PATENT DOCUMENTS

JP 2005021809 A 1/2005

* cited by examiner

*Primary Examiner* — Juanita D Jackson
(74) *Attorney, Agent, or Firm* — Canon USA, Inc., IP Division

(57) ABSTRACT

An ink jet recording apparatus includes a recording head, a carriage, a wiping unit, and a control unit. The recording head includes a discharging port surface provided with a first discharging port row group having at least one discharge port row formed by arraying a plurality of discharging ports in a predetermined direction and a second discharging port row group having at least one discharge port row formed by arraying a plurality of discharging ports in a predetermined direction. The carriage causes the recording head to scan reciprocally in a direction intersecting the predetermined direction. The wiping unit includes a sheet member for wiping the discharge port surface and a winding device to wind the sheet member. The control unit controls the winding device so that the first discharge port row group and the second discharge port row group are wiped with different areas of the sheet member.

16 Claims, 6 Drawing Sheets

INK JET RECORDING APPARATUS AND METHOD OF WIPING RECORDING HEAD DISCHARGE PORT ROW GROUPS

BACKGROUND OF THE INVENTION

1. Field of the Invention

The present invention relates to an ink jet recording apparatus and a method of wiping a recording head.

2. Description of the Related Art

There may occur a trouble that ink is adhered to a surface of a recording head of an ink jet recording apparatus in which discharging ports are formed (hereinafter, referred to as "discharging port surface") and hence normal discharging is impaired. As a method of preventing such a trouble, the ink jet recording apparatus generally provided with a wiping unit configured to wipe ink adhered to the discharging ports.

The wiping unit as described above includes a wiping member formed of a material having resiliency, for example, for wiping the discharge port surface, and an abutting member configured to bring the wiping member into contact with the discharging port surface. A wiping action is achieved by bringing the wiping member to abut against the discharging port surface and scrubbing the same at a predetermined timing. As a method of wiping the recording head in a so-called serial-type ink jet recording apparatus configured to perform recording during a reciprocal movement of a carriage on which the recording head is mounted, a method of wiping by causing the abutting member to move while the reciprocal movement is stopped, or a method of wiping by moving the recording head in a state of abutting against the abutting member are known. The latter method, that is, the method of wiping during the movement of the recording head, is more effective especially when the frequency of wiping the recording head is higher. In other words, since the wiping action can be performed during the reciprocal movement of the carriage, the period required for each wiping action may be shorter than that in the method of performing the wiping action while the reciprocating operation is stopped.

Japanese Patent Laid-Open No. 2005-21809 discloses an example of scrubbing a recording head in the vertical direction with respect to a discharge port row of the recording head using a sheet-type wiping member. It is known that a wiping effect higher than that of the method of wiping the recording head by scrubbing using a so-called wiper blade is expected when this sheet-type wiping member is used.

In recent years, the recording using inks of a plurality of colors or inks having reactivity with respect to each other may be performed with the identical recording head in association with diversification of the ink jet recording apparatus and the recording method. In such a case, when the wiping action is performed by the identical wiping member, one ink may get mixed into discharging port of the other ink and, consequently, troubles such as image impairment like color mixture or a discharge failure due to anchoring of the ink as a result of reaction may occur.

In the example disclosed in Japanese Patent Laid-Open No. 2005-21809, an attempt is made to resolve the trouble such as image impairment like color mixture or the discharge failure due to anchoring of the ink as a result of reaction by wounding the sheet-type wiping member. However, the resolution is not sufficient.

SUMMARY OF THE INVENTION

According to an aspect of the present invention, an ink jet recording apparatus includes a recording head having a discharging port surface provided with a first discharging port row group having at least one discharge port row formed by arraying a plurality of discharging ports in a predetermined direction and a second discharging port row group having at least one discharge port row formed by arraying a plurality of discharging ports in a predetermined direction, a carriage configured to cause the recording head to scan reciprocally in a direction intersecting the predetermined direction, a wiping unit including a sheet member for wiping the discharge port surface and a winding device configured to wind the sheet member, and a control unit configured to control the winding device so that the first discharge port row group and the second discharge port row group are wiped with different areas of the sheet member.

The present invention provides an ink jet recording apparatus configured to be capable of preventing a trouble such as color mixture or anchoring of ink in a wiping action.

Accordingly, the first discharge port row and the second discharge port row may be wiped with different areas of the sheet member, and hence a trouble such as color mixture or discharge failure may be reduced.

Further features of the present invention will become apparent from the following description of exemplary embodiments with reference to the attached drawings.

DESCRIPTION OF THE EMBODIMENTS

Figure 1:
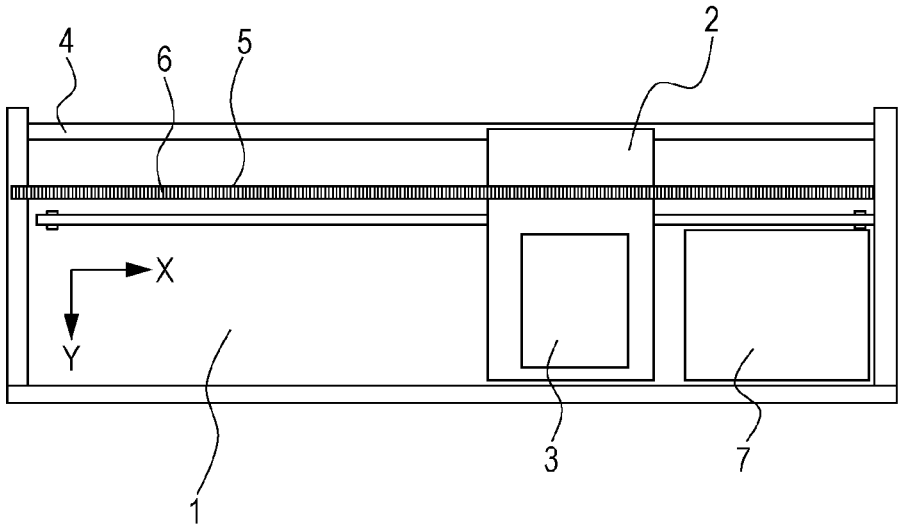
FIG. 1 is a plan view illustrating an ink jet recording apparatus according to a first embodiment.

Referring now to the drawings, embodiments of the invention will be described.

First Embodiment

An ink jet recording apparatus of a first embodiment illustrated in FIG. 1 is a serial-type ink jet recording apparatus, and a recording apparatus body 1 includes various mechanism sections including a conveyance system unit (not illustrated) of a recording medium. The serial-type recording apparatus is configured to convey the recording medium in a Y-direction (sub-scanning direction) by the conveyance system unit intermittently, and perform a recording action while moving a recording head 3 in an X-direction (main scanning direction) intersecting the sub-scanning direction. The recording action is performed during a reciprocal movement along the X-direction. The recording apparatus body 1 illustrated in FIG. 1 has a configuration increased in size in the X-direction so as to allow recording on a relatively large recording medium (for example, A1 size).

The movement of the recording head 3 is achieved by a carriage 2. Specifically, the recording head 3 is demountably mounted on the carriage 2 and the carriage 2 moves reciprocally along the X-direction together with the recording head 3. Furthermore, the carriage 2 is supported so as to be movable on a straight line along a guide shaft 4 arranged along the X-direction, and is fixed to an endless belt 5 moving substantially parallel to the guide shaft 4. The endless belt 5 moves reciprocally by a drive force of a carriage motor (CR motor), whereby causes the carriage 2 to move reciprocally in the X-direction. The recovery process apparatus 7 configured to perform recovery process on a discharging action of the recording head 3 is arranged outside of an area where the recording medium is conveyed, which is one side in the direction of reciprocal movement of the carriage.

Figure 2:
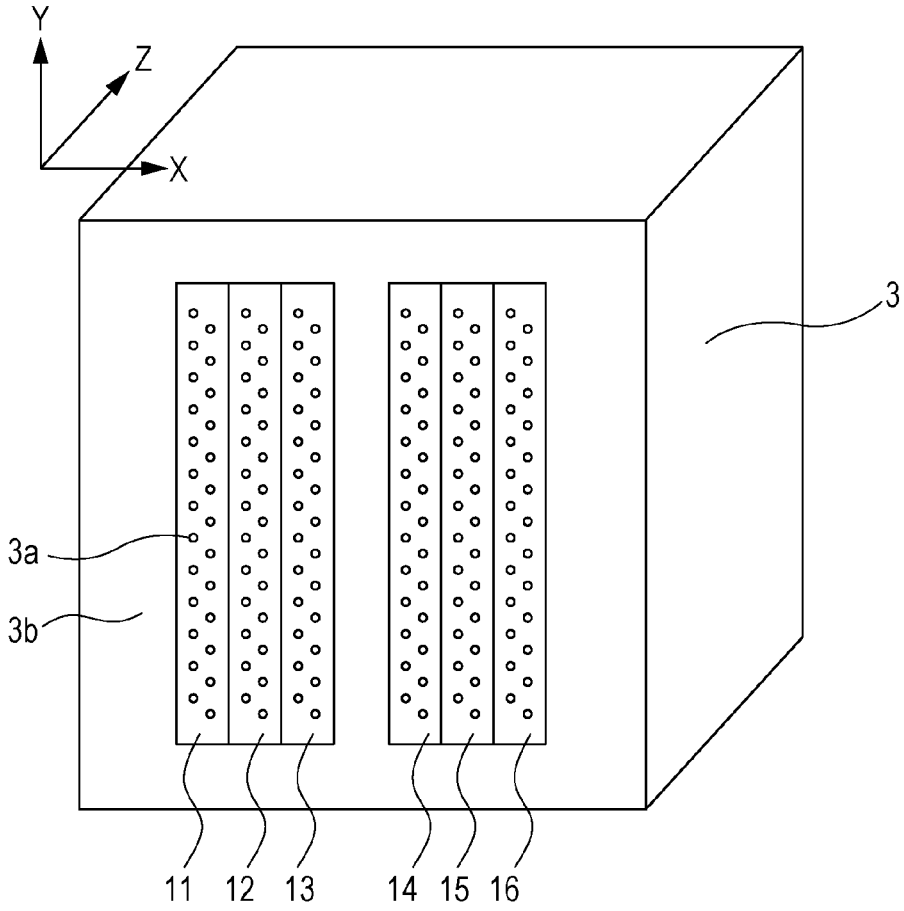
FIG. 2 is a schematic drawing illustrating a recording head according to the first embodiment.

FIG. 2 is a schematic drawing of the recording head 3 mounted on the carriage 2. The recording head 3 includes a plurality of discharge ports 3*a* formed on a discharge port surface 3*b* along the Y-direction, a plurality of liquid channels formed (not illustrated) corresponding to the individual discharge ports 3*a*, and a common liquid chamber (not illustrated) configured to supply ink to the plurality of liquid channels as illustrated in FIG. 2. In addition, a plurality of discharge port rows including the plurality of discharge ports 3*a* arrayed in the Y-direction are provided along the X-axis direction. In other words, the plurality of discharge port rows are arranged in parallel to each other in the direction intersecting the arrayed direction of the discharge ports. FIG. 2 illustrates the recording head 3 having a plurality of discharge port rows 11 to 16. The invention is not limited to a configuration having a plurality of discharge port rows on one head, but also includes a configuration in which a plurality of discharge port rows on a plurality of heads. The plurality of discharge port rows of the first embodiment includes 1280 of the discharge ports 3*a* arranged in the Y direction so as to achieve discharge of the ink of the same color for printing at a density of 1200 dpi (dot per inch).

Each of the liquid channels of the recording head 3 includes energy-generating element configured to generate discharge energy for causing the ink to be discharged from the discharge ports 3*a* arranged therein. In the first embodiment, an electrothermal conversion member configured to heat the ink locally to cause film boiling and cause the ink to be discharged by the pressure thereof is used as the energy-generating element. However, the invention is not limited thereto, and an electromechanical conversion element may also be used. In the description given below, the discharge ports 3*a* and the liquid channel are collectively referred to as a nozzle.

Inks containing different color materials are supplied to the recording head 3 from ink tanks (not illustrated) in which the respective inks are stored corresponding to the above-described six discharge port rows. From the respective ink tanks provided in the recording apparatus body, the respective inks are supplied through tubes (not illustrated) coupled to ink supply ports of the discharge port rows 11 to 16 corresponding thereto, respectively. In the configuration of the discharge port rows 11 to 16 of the first embodiment, inks of cyan, magenta, yellow, pale gray, gray, and black are discharged in sequence.

Figure 3:
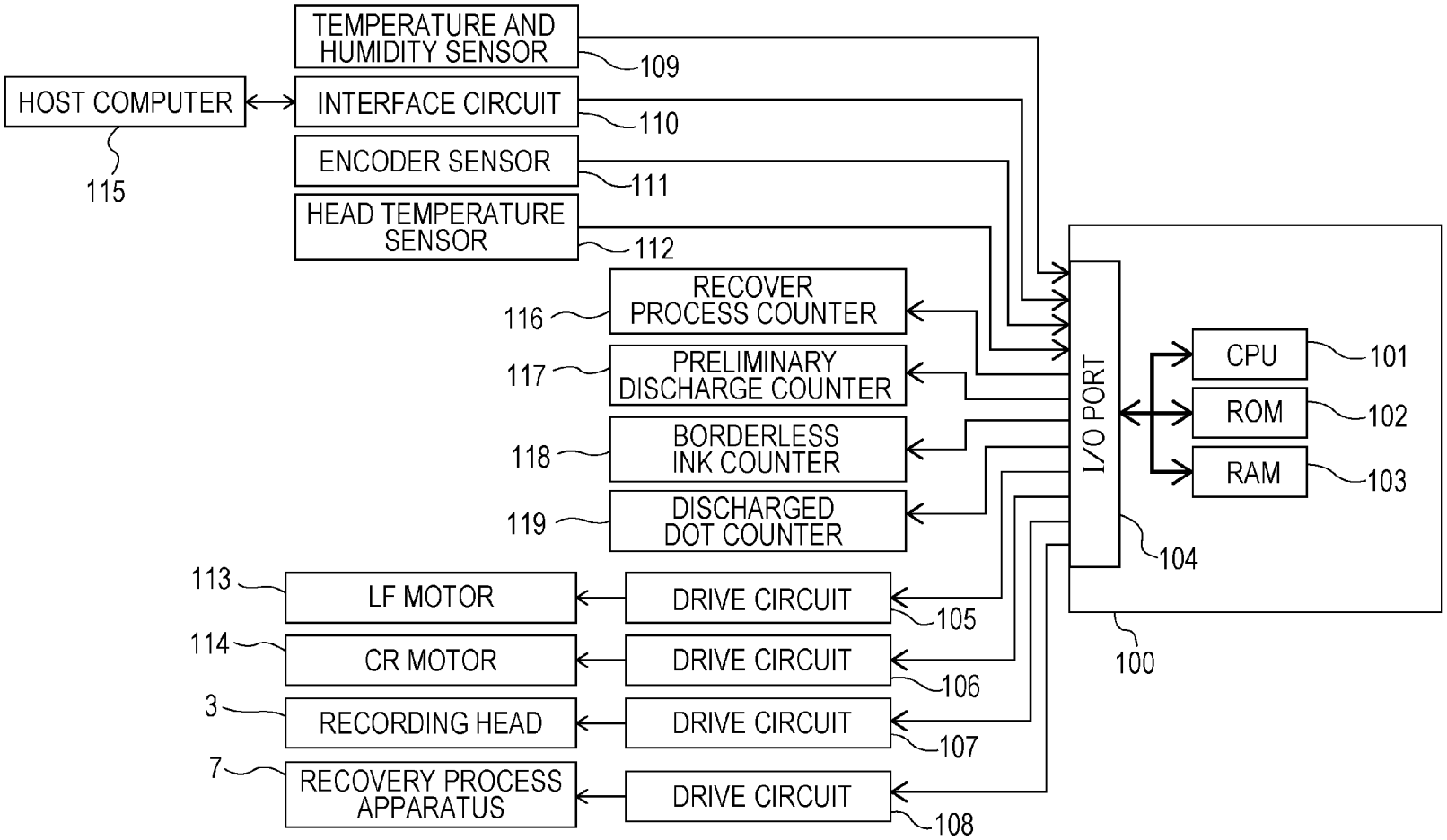
FIG. 3 is a block diagram illustrating a configuration of a control system (control unit) mounted on an ink jet recording apparatus body of the first embodiment.

FIG. 3 is a block diagram illustrating a configuration of a control system (control unit) mounted on the recording apparatus body 1 of the ink jet recording apparatus of the first embodiment. The recording apparatus body 1 includes a main control unit 100 as illustrated in FIG. 3. The main control unit 100 includes a CPU 101 configured to execute process actions such as calculation, control, determination, and setting, a ROM 102 configured to store a control program or the like to be executed by the CPU 101, a RAM 103 used as a buffer configured to store binary recording data indicating discharging/non-discharging of the ink and a work area for the processing performed by the CPU 101, and an I/O port 104.

Drive circuits 105, 106, 107, and 108 configured to drive a conveying motor (LF motor) 113, a carriage motor (CR motor) 114, the recording head 3, and the recovery process apparatus 7 respectively are connected to the I/O port 104. In addition, a head temperature sensor (head temperature detecting unit) 112 configured to detect the temperature of the recording head 3, an encoder sensor 111 fixed to the carriage 2, a temperature and moisture sensor 109 configured to sense the temperature and the moisture, which is an environment of usage of the recording apparatus body 1, and other sensors (not illustrated) are connected to the I/O port 104. The main control unit 100 is connected to a host computer 115 via an interface circuit 110.

A recovery process counter 116, a preliminary discharge counter 117, a borderless ink counter 118, and a discharge dot counter 119 are also connected to the I/O port 104. The recovery process counter 116 is configured to count the amount of ink when the ink is forcedly drained from the recording head 3 by the recovery process apparatus 7. The preliminary discharge counter 117 is configured to count the number of times of discharge (the amount of consumption of ink) for a preliminary discharge performed before starting recording, after having finished the recording, and during the recording. The borderless ink counter 118 is configured to count the amount of ink recorded out of a recording medium area when performing borderless ink recording. Furthermore, the discharge dot counter 119 is configured to count the number of times of discharge of the ink discharged during the recording.

Subsequently, the recording action executed by the ink jet recording apparatus having the configuration as described above will be described. When the ink jet recording apparatus receives recording data from the host computer 115 via an interface, the recording data is deployed in the buffer of the RAM 103. Then, when a command of the recording action is given, the conveying unit (not illustrated) is activated, and the recording medium is conveyed to a position opposing the discharging port surface 3*b* of the recording head 3. Here, the carriage 2 moves in the X direction along the guide shaft 4. Ink droplets are discharged from the recording head 3 in association with the movement of the carriage 2, and an image corresponding to an amount of one band is recorded on the recording medium. Subsequently, the recording medium is conveyed by an amount corresponding to one band in the Y direction intersecting (orthogonal to) the direction of movement of the carriage 2 by the conveying unit. By repeating the actions described above, a predetermined image is formed on the recording medium.

The position of the carriage 2 is detected by counting pulse signals output from the encoder sensor 111 in association with the movement of the carriage 2 by the main control unit 100. In other words, the encoder sensor 111 outputs the pulse signals to the main control unit 100 by detecting sections formed at regular intervals on an encoder film 6 (see FIG. 1) arranged along the X direction. The main control unit 100 detects the position of the carriage 2 by counting the pulse signals. Movements of the carriage 2 to a home position and other positions are performed on the basis of the signals from the encoder sensor 111.

(Recovery Process Apparatus)

Figure 4:
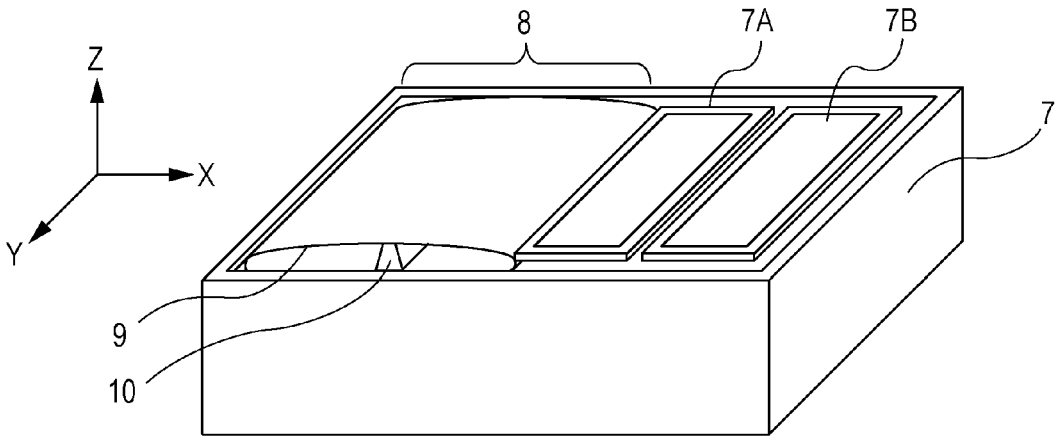
FIG. 4 is a schematic drawing illustrating a recovery process apparatus according to the first embodiment.

FIG. 4 illustrates the recovery process apparatus 7 for maintaining the ink discharge performance from the respective discharge ports 3*a* of the recording head 3 in a good state in detail. The recovery process apparatus 7 is fixedly held at a predetermined position of the recording apparatus body 1 (see FIG. 1). The recovery process apparatus 7 includes suction recovery mechanisms 7A and 7B, an elevating mechanism (not illustrated) configured to move upward and downward the suction recovery mechanisms 7A and 7B, and a wiping unit 8. The suction recovery mechanisms 7A and 7B perform a suction recovery process which is a form of the recovery process. The suction recovery process here means a process of replacing ink in a plurality of the nozzles (flow channels including the discharging ports) formed in the recording head by ink suitable for being discharged by forcedly sucking ink from the nozzles. Specifically, the suction recovery mechanisms 7A and 7B cover the discharge port surface 3*b* with caps and cause a negative pressure to be generated in the cap by a pump (not illustrated) communicating with internal spaces of the caps, and forcedly suck the ink from the discharge ports 3*a* by the negative pressure therein. One of the suction recovery mechanisms 7A and 7B performs the suction recovery process for the three discharge port rows 11 to 13 and the other suction recovery mechanism performs the suction recovery process for the three remaining discharge port rows 14 to 16.

The wiping unit 8 is provided at a reciprocal movement reversing position (for example, outside of the area where the recording medium is conveyed, and on the side of the recording medium with respect to the recovery process apparatus) of the recording head 3. The wiping unit 8 includes a wiping member 9 formed of a continuing sheet-type material, an abutting member 10 pressing the wiping member 9 for bringing the wiping member 9 into contact with the discharge port surface 3*b*, and an abutting member moving unit (not illustrated) configured to allow the movement of the abutting member 10 between an abutting position (contact position) where the discharge port surface 3*b* abuts against the wiping member 9 and a retracted position where the discharge port surface 3*b* does not abut against the wiping member 9.

The ink anchored to the discharge port surface 3*b* may be removed by performing the wiping action using the wiping unit 8 configured as described thus far. Non-woven fabrics formed by using polyolefin, PET or nylon is preferable as a material used for the wiping member 9 configured as described thus far. In order to enhance the wiping performance, the wiping member 9 is preferably wet by being impregnated with impregnating fluid in advance. The impregnating fluid is preferably liquid which is capable of wiping off the anchored ink and, specifically, liquid including water, a surface active agent, and solvent may be used.

The components as described above of the recovery process apparatus 7 are controlled by a control unit, described above (FIG. 3).

(Wiping Action)

Figure 5A:
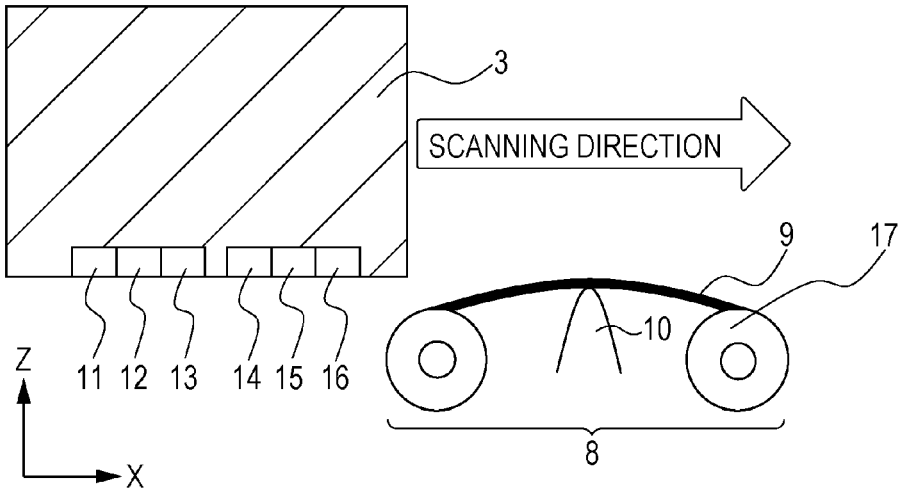
FIGS. 5A and 5B are schematic drawings illustrating a configuration of a wiping unit and a wiping action according to the first embodiment.
Figure 5B:
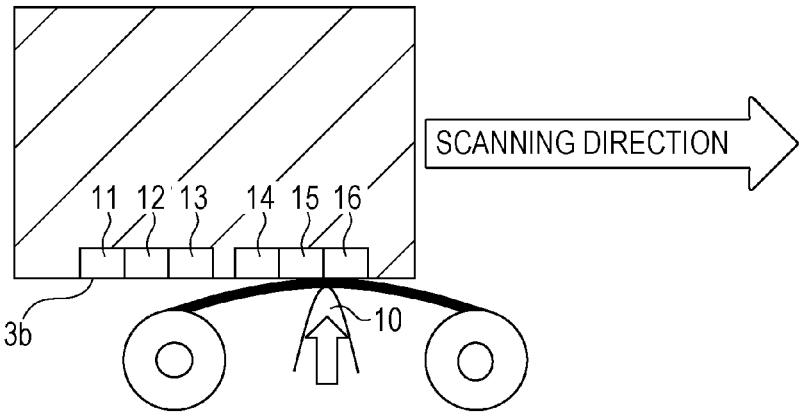

FIGS. 5A and 5B are side views illustrating the wiping action of the wiping unit 8 for wiping the recording head 3. A winding apparatus 17 is an apparatus for winding the wiping member 9. The winding apparatus 17 is capable of operating irrespective of the vertical position (position in a Z direction) of the abutting member 10. As described above, the abutting member 10 is held by the abutting member moving unit configured to be movable between the abutting position and the retracted position.

FIG. 5A illustrates a state in which the recording head 3 moves in the direction of the wiping unit 8. Here, the movement of the recording head 3 is equivalent to the movement of the carriage described above, and the expression "the movement of the recording head" is employed in the following description, because the recording head is focused. FIG. 5B illustrates a state in which the wiping member 9 wipes the discharge port row 16 of the discharging port surface.

In the first embodiment, after the nozzle rows of a first group are wiped, the wiping member is wound so as to expose a wiping surface for the next action, and then the wiping action for wiping the nozzle rows of a second group is performed so as to prevent color mixture, reaction and the like from occurring via the wiping member.

FIGS. 6A to 6E illustrates an example of the wiping action in which the first group including the discharge port rows 13, 12 and 11 and the second group including the discharge port rows 14, 15 and 16 are distinctively wiped by the wiping unit 8. The wiping step proceeds on the order of FIG. 6A, FIG. 6B, FIG. 6C, FIG. 6D, and FIG. 6E with time.

Figure 6A:
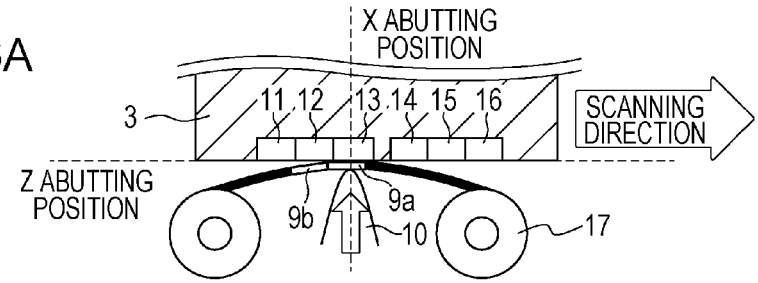
FIGS. 6A to 6E are schematic drawings illustrating an action for distinctively wiping discharge port rows according to the first embodiment.

An X abutting position illustrated by a chain line in FIG. 6A is a position in the X direction of the wiping member 9 (the abutting member 10). A Z abutting position is the position in the Z direction of the wiping member 9 (the abutting member 10) when the wiping member 9 abuts against the discharging port surface. Furthermore, one part (area 9*a*) of the wiping member corresponds to an area used for wiping the first group, and the other part (area 9*b*) of the wiping area corresponds to an area used for wiping the second group, respectively. A Z retracting position illustrated by a chain line in FIG. 6C is a position in the Z direction of the wiping member 9 when the wiping member 9 does not abut against the discharging port surface.

Figure 6B:
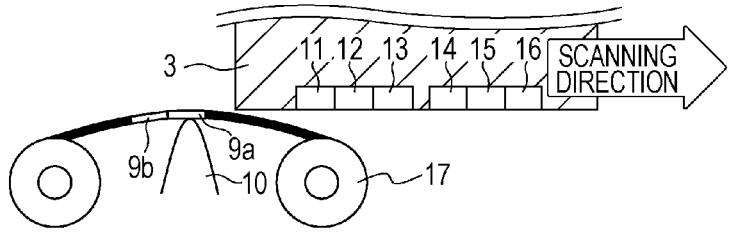

First of all, as illustrated in FIG. 6A, by moving the abutting member 10 upward when the discharge port row 13 is located at the X abutting position after the recording head 3 moves in the outward direction and the discharge port rows 16, 15, and 14 of the recording head 3 pass through the X abutting position, the wiping member 9 moves to the Z abutting position. Then, the recording head 3 moves in the outward direction in a state in which the wiping member 9 is still at the Z abutting position, and the discharge port rows 13, 12, and 11 are wiped with the area 9*a* of the wiping member in this order (13→12→11). Subsequently, as illustrated in FIG. 6B, the wiping member 9 is maintained at the Z abutting position until the entire recording head 3 passes through the X abutting position even after the discharge port row 11 is wiped by the wiping member 9.

Figure 6C:
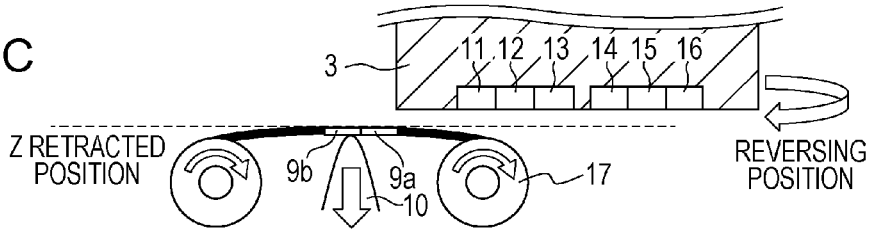

Subsequently, as illustrated in FIG. 6C, by moving the abutting member 10 downward, the wiping member 9 moves to the Z retracted position. Then, the area of the wiping member 9 where the first group is wiped moves rightward by winding the wiping member 9 by rotating the winding apparatus 17. Accordingly, the area of the wiping member 9 which is capable of abutting against the discharging port surface by being pressed by the abutting member 10 is changed from the area 9*a* to the area 9*b*. Then, the recording head 3 is moved in the outward direction to a reversing position, and is reversed and moves in the homeward direction.

Figure 6D:
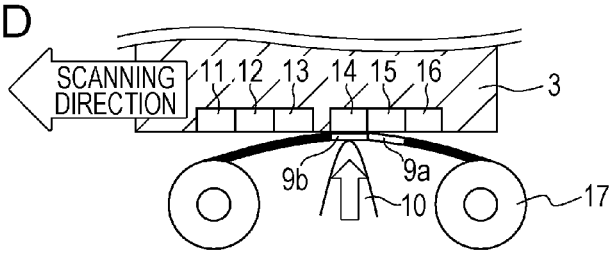
Figure 6E:
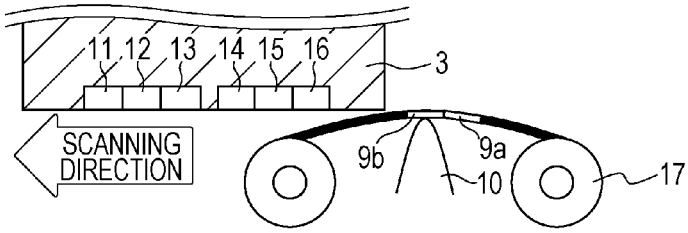

Furthermore, as illustrated in FIG. 6D, by moving the abutting member 10 upward when the discharge port row 14 is positioned at the X abutting position after the recording head 3 moves in the homeward direction and the discharge port rows 11, 12, and 13 of the recording head 3 pass through the X abutting position, the wiping member 9 moves to the Z abutting position. The recording head 3 moves in the homeward direction in a state in which the wiping member 9 is still at the Z abutting position, and the discharge port rows 14, 15 and 16 are wiped in this order (14→15→16) with the area 9*b* of the wiping member. Subsequently, as illustrated in FIG. 6E, the wiping member 9 is maintained at the Z abutting position until the entire recording head 3 passes through the X abutting position even after the discharge port row 16 is wiped by the wiping member 9.

As described above, the discharge port row 11 of the first group discharges cyan ink, the discharge port row 12 discharges magenta ink, the discharge port row 13 discharges yellow ink, the discharge port row 14 discharges pale gray ink, the discharge port row 15 discharges gray ink, and the discharge port row 16 discharges black ink. If the discharge port row for the color ink is wiped off with the same surface of the wiping member after the discharge port row for the gray or black ink has wiped, it may be said that the probability of mixture of the gray or black ink into the discharge port row for the color ink via the wiping member 9 is high. However, as illustrated in FIGS. 6A to 6E, the color mixture may be prevented by differentiating the area 9*a* for wiping the first discharge port row group (the discharge port rows 13, 12 and 11) of the wiping member 9 and the area 9*b* for wiping the second discharge port row group (the discharge port rows 14, 15, and 16) of the wiping member 9.

Since the yellow ink among other color inks is significantly affected if other color inks are mixed, it is preferable that the discharge port row 11 for the yellow ink is wiped first from among the discharge port rows of the first group. In other words, the discharge port row 11 to be wiped at the end from the first group (the discharge port rows 13, 12 and 11) is a discharge port row at the last row with respect to the movement in the outward direction of the recording head 3. Since the wiping member 9 is maintained at the Z abutting position after the discharge port row 11 is wiped with the wiping member 9 until the entire recording head 3 passes through the X abutting position, the mixed color ink on the wiping member 9 generated by the wiping action does not accumulated on the discharging port surface of the recording head 3.

In addition, as regards the discharge port row for the gray or black ink, since the pale gray ink is significantly affected if other black or dark gray ink is mixed, it is preferable that the discharge port row 14 of the pale gray among the discharge port rows in the second group is wiped first. In other words, the discharge port row 16 to be wiped at the end from the second group (the discharge port rows 14, 15 and 16) is a discharge port row at the last row with respect to the movement in the homeward direction of the recording head 3. Since the wiping member 9 is maintained at the Z abutting position after the discharge port row 16 is wiped with the wiping member 9 until the entire recording head 3 passes through the X abutting position, the mixed color ink on the wiping member 9 generated by the wiping action does not accumulated on the discharging port surface of the recording head 3.

By performing the action of winding the wiping member between the outward direction and the homeward direction, it is not necessary to lower the speed of the carriage during the wiping operation. Therefore, a time loss is not generated and the wiping action may be completed.

When performing recording using inks having reactivity with respect to each other by the identical recording head, even when the inks in the first group (the discharge port rows 11, 12, and 13) and the inks in the second group (the discharge port rows 14, 15, and 16) are ink sets reactive to each other, for example, anchoring caused by the reaction may be prevented by wiping the first group and the second group distinctively using different areas of the wiping member 9. In contrast, according to the example of the related art in which the discharge port rows are wiped without distinction, the area of the wiping member 9 to be used for wiping (for example, wiping in the order of the discharge port rows 16→15→14→13→12→11 at once), anchoring of ink by the reaction cannot be prevented.

Although the configuration in which the abutting member 10 is pushed upward when the discharge port row to be wiped is located at the X abutting position has been described, it is also possible to employ a configuration in which the abutting member 10 is pushed upward when a portion between the first group and the second group is located at the X-abutting position.

Although the configuration in which two groups each including three discharge port rows from the six discharge ort rows mounted on the recording head 3 are wiped with different areas of the wiping member has been described, a configuration in which one discharge port row is wiped with an area of the wiping member different from another discharge port row, or a configuration in which one discharge port row is wiped with an area of the wiping member different from an area used for wiping two or more other discharge port rows is also applicable.

Although the configuration in which the area of the wiping member 9 used for wiping the first group is wound in the direction in which the recording head 3 move toward the reversing position has been described. However, a configuration in which the area of the wiping member 9 used for wiping the first group is wound in the opposite direction is also applicable.

Although the example in which the wiping member 9 is wound at the timing between the outward direction and the homeward direction has been described in the first embodiment, the wiping member 9 may be wound by the winding device so that the first group and the second group are wiped with the different areas of the wiping member 9 during scanning in one direction.

[Second Embodiment]

In a second embodiment, an example in which the same discharge port row abuts against the wiping member first before and after the reverse in the reciprocating motion of the carriage will be described. With reference to FIGS. 7A to 7E, control of the wiping action of the second embodiment will be described.

FIGS. 7A to 7E illustrate an example of the wiping action in which the first group including the discharge port rows 14, 13, 12 and 11 and the second group including the discharge port rows 14, 15 and 16 are distinctively wiped by the wiping unit 8. The wiping step proceeds on the order of FIGS. 6A to 6D, and FIG. 6E with time. One part (area 9*a*) of the wiping member corresponds to an area used for wiping the first group, and the other part (area 9*b*) of the wiping area corresponds to an area used for wiping the second group, respectively. Other appellations in the drawing are the same as those in the drawings up to FIG. 6E, and hence the description is omitted.

Figure 7A:
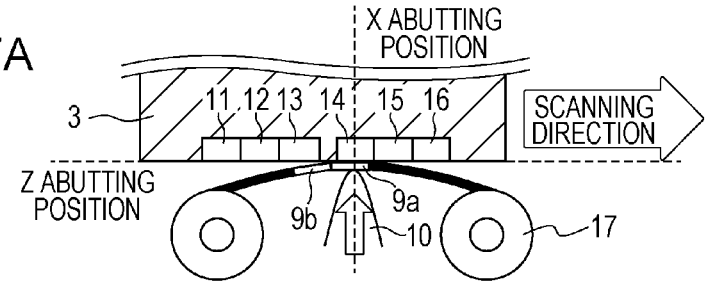
FIGS. 7A to 7E are schematic drawings illustrating an action for distinctively wiping the discharge port rows according to a second embodiment in detail.
Figure 7B:
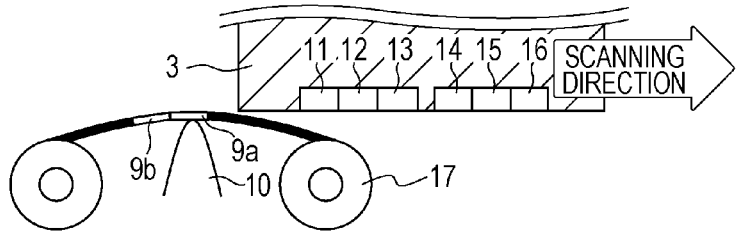

First of all, as illustrated in FIG. 7A, by moving the abutting member 10 upward when the discharge port row 14 is located at the X abutting position after the recording head 3 moves in the outward direction and the discharge port rows 16 and 15 of the recording head 3 pass through the X abutting position, the wiping member 9 moves to the Z abutting position. Then, the recording head moves in the outward direction in a state in which the wiping member 9 is still at the Z abutting position, and the discharge port rows 14, 13, 12 and 11 are wiped by the area 9*a* of the wiping member in this order (14→13→12→11). Subsequently, as illustrated in FIG. 7B the wiping member 9 is maintained at the Z abutting position until the entire recording head 3 passes through the X abutting position even after the discharge port row 11 is wiped by the wiping member 9.

Figure 7C:
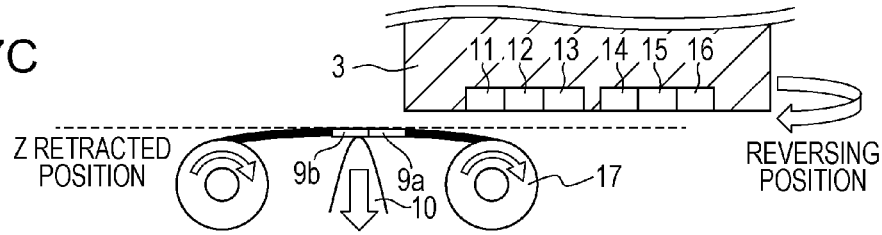

Subsequently, as illustrated in FIG. 7C, by moving the abutting member 10 downward, the wiping member 9 moves to the Z retracted position. Then, the area of the wiping member 9 where the first group is wiped moves rightward by winding the wiping member 9 by rotating the winding apparatus 17. Accordingly, the area of the wiping member 9 which is capable of abutting against the discharging port surface by being pressed by the abutting member 10 is changed from the area 9*a* to the area 9*b*. Then, the recording head 3 moves outward to a reversing position, and is reversed and moves in the homeward direction.

Figure 7D:
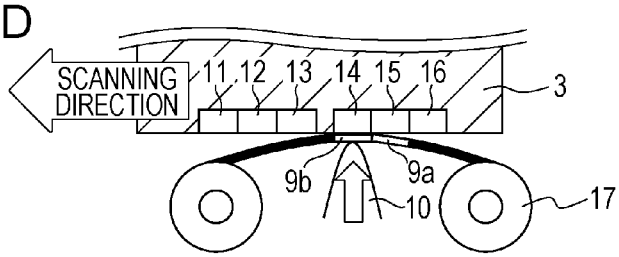
Figure 7E:
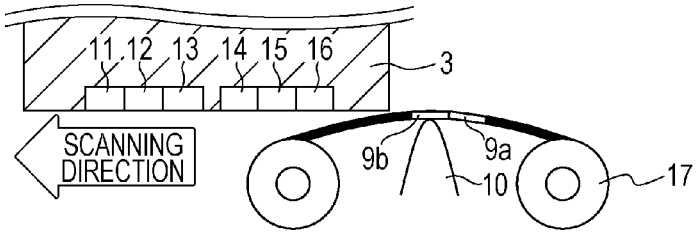

Furthermore, as illustrated in FIG. 7D, by moving the abutting member 10 upward when the discharge port row 14 is positioned at the X abutting position after the recording head 3 moves in the homeward direction and the discharge port rows 11, 12, and 13 of the recording head 3 pass through the X abutting position, the wiping member 9 moves to the Z abutting position. Then, the recording head 3 moves in the homeward direction in a state in which the wiping member 9 is still at the Z abutting position, and the discharge port rows 14, 15 and 16 are wiped in this order (14→15→16) with the area 9*b* of the wiping member 9. Subsequently, as illustrated in FIG. 7E, the wiping member 9 is maintained at the Z abutting position until the entire recording head 3 passes through the X abutting position even after the discharge port row 16 is wiped by the wiping member 9.

With the actions performed as described above, the discharge port row 14 is wiped twice with the wiping member 9 before and after the reverse of the recording head 3, the discharge port row 14 is intensively cleaned. In addition, the area 9*a* for wiping the first discharge port row group (the discharge port rows 14, 13, 12, and 11) of the wiping member 9 and the area 9*b* for wiping the second discharge port row group (the discharge port rows 14, 15, and 16) may be differentiated and hence the recording head 3 may be wiped distinctively before and after the reverse in the reciprocal motion of the recording head 3.

In other words, the second embodiment is specifically effective, for example, when the anchoring property of the ink itself in the discharge port row 14 is strong, that is, when one discharge port row needs to be wiped more intensively than other discharge port rows.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-079534, filed Mar. 30, 2012, and No. 2013-014452 filed Jan. 29, 2013, which are hereby incorporated by reference herein in their entirety.

What is claimed is:

1. An ink jet recording apparatus comprising:

a recording head having a discharge port surface provided with a first discharge port row group and second discharge port row group, wherein the first discharge port row group includes at least one discharge port row formed by arraying a plurality of discharge ports in a predetermined direction and the second discharge port row group includes at least one discharge port row formed by arraying a plurality of discharge ports in the predetermined direction;

a carriage configured to cause the recording head to move reciprocally in a direction intersecting the predetermined direction;

a wiping unit including a sheet member for wiping the discharge port surface and a winding device configured to wind the sheet member; and a control unit configured to control the sheet member to wipe the first discharge port row group while the carriage is moving in a first direction, and to wipe the second discharge port row group while the carriage is moving in a second direction opposite to the first direction.

2. The ink jet recording apparatus according to claim 1, wherein wiping action for wiping the discharge port surface of the recording head by the sheet member is performed while the carriage scans over the sheet member.

3. The ink jet recording apparatus according to claim 1, further comprising:

an abutting member configured to push part of the sheet member upward to bring the sheet member into contact with the discharge port surface when wiping action is performed.

4. The ink jet recording apparatus according to claim 1, wherein the wiping unit is located at an end of a scanning area of the carriage.

5. The ink jet recording apparatus according to claim 1, wherein the sheet member is impregnated with liquid.

6. The ink jet recording apparatus according to claim 1, wherein the first discharge port row group is configured to discharge color inks and the second discharge port row group is configured to discharge gray and black inks.

7. The ink jet recording apparatus according to claim 1, wherein the ink discharged from the first discharge port row group and the ink discharged from the second discharge port row group have properties reactive to each other.

8. The ink jet recording apparatus according to claim 1, wherein the control unit performs control so that the first discharge port row group and the second discharge port row group are wiped with different areas of the sheet member.

9. The ink jet recording apparatus according to claim 8, wherein the control unit controls the winding device to wind the sheet member after the sheet member wipes the first discharge port row group and before the sheet member wipes the second discharge port row group.

10. A method of wiping a recording head in an ink jet recording apparatus, wherein the ink jet recording apparatus includes a recording head having a discharge port surface provided with a first discharge port row group and second discharge port row group, wherein the first discharge port row group includes at least one discharge port row formed by arraying a plurality of discharge ports in a predetermined direction and the second discharge port row group includes at least one discharge port row formed by arraying a plurality of discharge ports in the predetermined direction, and wherein the ink jet recording apparatus further includes a carriage configured to cause the recording head to move reciprocally in a direction intersecting the predetermined direction, the method comprising:

wiping the first discharge port row group using a sheet member while the carriage is moving in a first direction; and wiping the second discharge port row group using the sheet member while the carriage is moving in a second direction opposite to the first direction.

11. The method according to claim 10, wherein wiping is performed at one end of a scanning area of the carriage.

12. The method according to claim 10, wherein wiping includes using a liquid impregnated in the sheet member.

13. The method according to claim 10, wherein the first discharge port row group is used for discharging color inks and the second discharge port row group is used for discharging gray and black inks.

14. The method according to claim 10, wherein properties of the ink discharged from the first discharge port row group and properties of the ink discharged from the second discharge port row group react to each other.

15. The method according to claim 10, wherein an area of the sheet member for the wiping in the second wiping step is different from an area of the sheet member for the wiping in the first wiping step.

16. The method according to claim 15, further comprising winding the sheet member after wiping the first discharge port row group and before wiping the second discharge port row group.

* * * * *